US006935541B1

(12) United States Patent
Campbell et al.

(10) Patent No.: US 6,935,541 B1
(45) Date of Patent: Aug. 30, 2005

(54) CAULK GUN PRESSURIZING SYSTEM

(75) Inventors: David C. Campbell, Bel Air, MD (US); Louis A. Gibbons, Stevensville, MD (US)

(73) Assignee: Black & Decker Inc., Newark, DE (US)

( * ) Notice: Subject to any disclaimer, the term of this patent is extended or adjusted under 35 U.S.C. 154(b) by 0 days.

(21) Appl. No.: 10/920,048

(22) Filed: Aug. 17, 2004

(51) Int. Cl.[7] ..... B67D 5/40

(52) U.S. Cl. ..... 222/380; 222/89; 222/222; 222/397; 222/39; 137/557

(58) Field of Search ..... 222/380, 389, 222/399, 397, 39; 137/557

(56) References Cited

U.S. PATENT DOCUMENTS

| | | | | |
|---|---|---|---|---|
| 2,818,999 | A | | 1/1958 | Miller |
| 3,138,303 | A | | 6/1964 | Hoveland |
| 3,308,998 | A | | 3/1967 | Oppasser et al. |
| 3,568,892 | A | | 3/1971 | Burk |
| 3,587,930 | A | | 6/1971 | Schultz |
| 3,640,431 | A | | 2/1972 | Plumer |
| RE28,120 | E | | 8/1974 | Plumer |
| 3,877,610 | A | | 4/1975 | Dickey |
| 3,980,209 | A | | 9/1976 | Collar |
| 3,983,947 | A | | 10/1976 | Wills et al. |
| 3,987,939 | A | | 10/1976 | Pedone, Jr. et al. |
| 4,215,802 | A | | 8/1980 | Ornsteen |
| 4,284,213 | A | | 8/1981 | Lee |
| 4,299,336 | A | | 11/1981 | Studer |
| 4,340,154 | A | | 7/1982 | VanManen |
| 4,376,498 | A | | 3/1983 | Davis, Jr. |
| 4,382,530 | A | | 5/1983 | Calisto |
| 4,386,717 | A | | 6/1983 | Koob |
| 4,426,022 | A | | 1/1984 | Lang et al. |
| 4,441,629 | A | | 4/1984 | Mackal |
| 4,453,651 | A | | 6/1984 | Braithwaite et al. |
| 4,461,454 | A | | 7/1984 | Vadnais |
| 4,637,531 | A | | 1/1987 | Olsson |
| 4,685,595 | A | | 8/1987 | Segatz |
| 4,788,729 | A | * | 12/1988 | Walker ..... 137/557 |
| 4,844,301 | A | | 7/1989 | Juillet |
| D303,914 | S | | 10/1989 | Hinden et al. |
| 4,925,061 | A | | 5/1990 | Jeromson, Jr. et al. |
| 4,957,225 | A | | 9/1990 | Childers |
| 4,986,444 | A | | 1/1991 | Corso |
| 5,058,769 | A | | 10/1991 | Kurtz |
| D321,309 | S | | 11/1991 | Myers |

(Continued)

FOREIGN PATENT DOCUMENTS

| | | |
|---|---|---|
| DE | 2036423 | 3/1971 |

(Continued)

OTHER PUBLICATIONS

Brandywine Associates, "Dispensing and Mixing Equipment for Adhesives and Chemicals", www.staticmixerdispenser.com/index, Feb. 10, 2003, 3 page printout.

(Continued)

*Primary Examiner*—Philippe Derakshani
(74) *Attorney, Agent, or Firm*—Harness, Dickey & Pierce, P.L.C.

(57) ABSTRACT

A device for dispensing a viscous material and a method for controlling the dispensing pressure. The device has a manually actuated control valve, that, when depressed, releases high pressure gas from the source, such as a $CO_2$ cartridge, into a gas enclosure. An indicator signals a pre-determined pressure in the gas enclosure sufficient to forcefully dispense a viscous material from a product cartridge.

18 Claims, 4 Drawing Sheets

U.S. PATENT DOCUMENTS

| | | | |
|---|---|---|---|
| 5,104,013 | A | 4/1992 | Hawley |
| 5,181,636 | A | 1/1993 | Anderson et al. |
| 5,203,507 | A | 4/1993 | Matthews |
| D342,654 | S | 12/1993 | Jens |
| D343,103 | S | 1/1994 | Bunce |
| 5,297,697 | A | 3/1994 | Boring |
| 5,361,941 | A | 11/1994 | Parekh et al. |
| D357,392 | S | 4/1995 | Kimpel et al. |
| 5,492,249 | A | 2/1996 | Beach |
| 5,535,925 | A | 7/1996 | Hinden et al. |
| 5,556,009 | A | 9/1996 | Motzko |
| 5,573,148 | A | 11/1996 | Poole et al. |
| 5,595,327 | A | 1/1997 | Dentler et al. |
| 5,833,099 | A | 11/1998 | Boaz et al. |
| 5,887,765 | A | 3/1999 | Broesamle |
| 6,022,504 | A | 2/2000 | Boaz et al. |
| 6,032,830 | A | 3/2000 | Brown |
| 6,039,223 | A | 3/2000 | Damask |
| 6,062,428 | A | 5/2000 | Callahan |
| 6,488,180 | B1 | 12/2002 | Bayat |
| 6,672,489 | B1 | 1/2004 | Huang |
| 2002/0108971 | A1 | 8/2002 | Lafond |
| 2002/0145014 | A1 | 10/2002 | Harris |
| 2004/0074927 | A1 | 4/2004 | Lafond |

FOREIGN PATENT DOCUMENTS

| | | |
|---|---|---|
| DE | 2944969 | 5/1980 |
| DE | 3409724 | 9/1985 |
| DE | 3526141 | 2/1986 |
| DE | 3526142 | 2/1986 |
| DE | 3920694 | 1/1991 |
| DE | 9419733.4 | 6/1995 |
| EP | 0290259 | 11/1988 |
| GB | 2162902 | 2/1986 |
| GB | 2162903 | 2/1986 |
| JP | 56-089865 | 7/1981 |
| JP | 62-011571 | 1/1987 |
| JP | 64-038164 | 2/1989 |
| JP | 02-144168 | 6/1990 |
| JP | 06-000428 | 1/1994 |
| JP | 06-099122 | 4/1994 |
| JP | 09-024981 | 1/1997 |
| JP | 2001-315864 | 11/2001 |

OTHER PUBLICATIONS

C.R. Laurence Co. Inc. (CRL), "CRL Introduces New Sealant and Caulking Gun Duo", USGLass, Metal & Glazing, Mar. 2001, p. 65.

Essex ARG, "EssexPak System Saves Time and Money", Glass Digest, May 15, 2001, p. 57.

TAH Industries, "Cartridge Systems", www.tah.com/display, Feb. 10, 2003, 1 page printout.

* cited by examiner

CAULK GUN PRESSURIZING SYSTEM

FIELD OF THE INVENTION

The present invention relates to viscous product dispensing devices; and more particularly, to a pressurizing system for gas cartridge driven dispensing devices.

BACKGROUND OF THE INVENTION

In general, pressure driven viscous product dispensing devices receive an input of relatively high pressure gas which is used to output a viscous product at a relatively low pressure. The dispensing devices may typically regulate the high pressure gas using a pressure regulator. In this way, a source of high pressure gas can be used to drive devices that require only a fraction of the high pressure to operate properly. Exemplary sources of high pressure gas include, for example, tanks of compressed air, aerosol containers and commercially available $CO_2$ gas cartridges.

Unfortunately, pressure regulators can be quite costly. The cost of a pressure regulator can become significant in relation to the overall cost of the device into which it is incorporated. This can be true, for example, in relation to dispensing devices for dispensing a viscous product from a viscous product cartridge. Such viscous product cartridges are commonly used in association with adhesives, caulks and other sealants. During periods of storage or idle periods, the viscous product is constantly exposed to regulated pressure from the high pressure source. Thus, it has been discovered that a low cost, reliable pressurizing system is desirable to minimize the number of possible leak points; particularly for use in dispensing devices for dispensing a viscous product from a viscous product cartridge.

SUMMARY OF THE INVENTION

In accordance with one aspect of the present invention, a device for dispensing a viscous product is provided. The device includes a housing component having a cavity and a dispensing orifice. A movable wall is positioned in the housing cavity and operates to separate a product enclosure from a gas enclosure. A fluid passage provides fluid communication between a pressurized gas source and the gas enclosure. A manually actuated control valve is associated with the pressurized gas source, and is adapted to release pressurized gas into the gas enclosure. The device has a pressure relief valve in fluid communication with the gas enclosure. The relief valve is adapted to indicate a predetermined pressure in the gas enclosure. An operator-activated trigger mechanism is disposed, operable to open the orifice and allow the viscous product to dispense.

In accordance with another aspect of the present invention, a device for dispensing a viscous product from a viscous product cartridge is provided. The dispensing device is adapted to be driven by pressurized gas. The device includes a first housing component adapted to retain the viscous product cartridge and to cooperate with the viscous product cartridge to form a gas enclosure separated from a product enclosure by a movable wall. A second housing component is provided with an inlet in sealed fluid communication with the gas enclosure. A pressurized gas source provides gas to the inlet, and a fluid passage provides fluid communication between the inlet and the gas enclosure. The device also has a manually actuated control valve. The valve has an actuator associated with the pressurized gas source and, upon actuation, releases pressurized gas through the inlet. The control valve is further adapted to return the actuator subsequent the actuation. An operator-actuated trigger mechanism is provided to permit dispensing of the viscous product.

In accordance with yet another aspect of the present invention, a method for facilitating the pressurized discharge of a viscous product from a viscous product cartridge is provided. The method includes providing a dispensing device adapted to receive and discharge a viscous product. A gas enclosure chamber is integrated within a housing of the dispensing device, and a control valve is supplied operable to selectively permit gas flow from a pressurized gas source to a fluid passage. The fluid passage is connected to the gas enclosure, and an indicator is incorporated and adapted to signal a pre-determined pressure in the gas enclosure.

Further areas of applicability of the present invention will become apparent from the detailed description provided hereinafter. It should be understood that the detailed description and specific examples, while indicating the preferred embodiment of the invention, are intended for purposes of illustration only and are not intended to limit the scope of the invention.

BRIEF DESCRIPTION OF THE DRAWINGS

The present invention will become more fully understood from the detailed description and the accompanying drawings, wherein.

DETAILED DESCRIPTION OF THE PREFERRED EMBODIMENTS

The following description of the preferred embodiment(s) is merely exemplary in nature and is in no way intended to limit the invention, its application, or uses. For example, although the pressurizing system of the dispensing device is described herein as preferably being driven by pressurized $CO_2$ cartridges, other sources of pressurized gas, including aerosol containers and compressed air tanks, may alternatively be used.

As used herein, "pressurized gas cartridge" means a container that is capable of housing a material that can be dispensed from the container in the form of a pressurized gas. Thus, it is possible that the material inside the container is, at least partially, in a form that is not gaseous. Similarly, the phrase "product cartridge" as used herein, means a container capable of housing a product for shipping and/or storage and for dispensing. Thus, the term "cartridge" does not, in itself, require any specific structural configuration.

Figure 1:
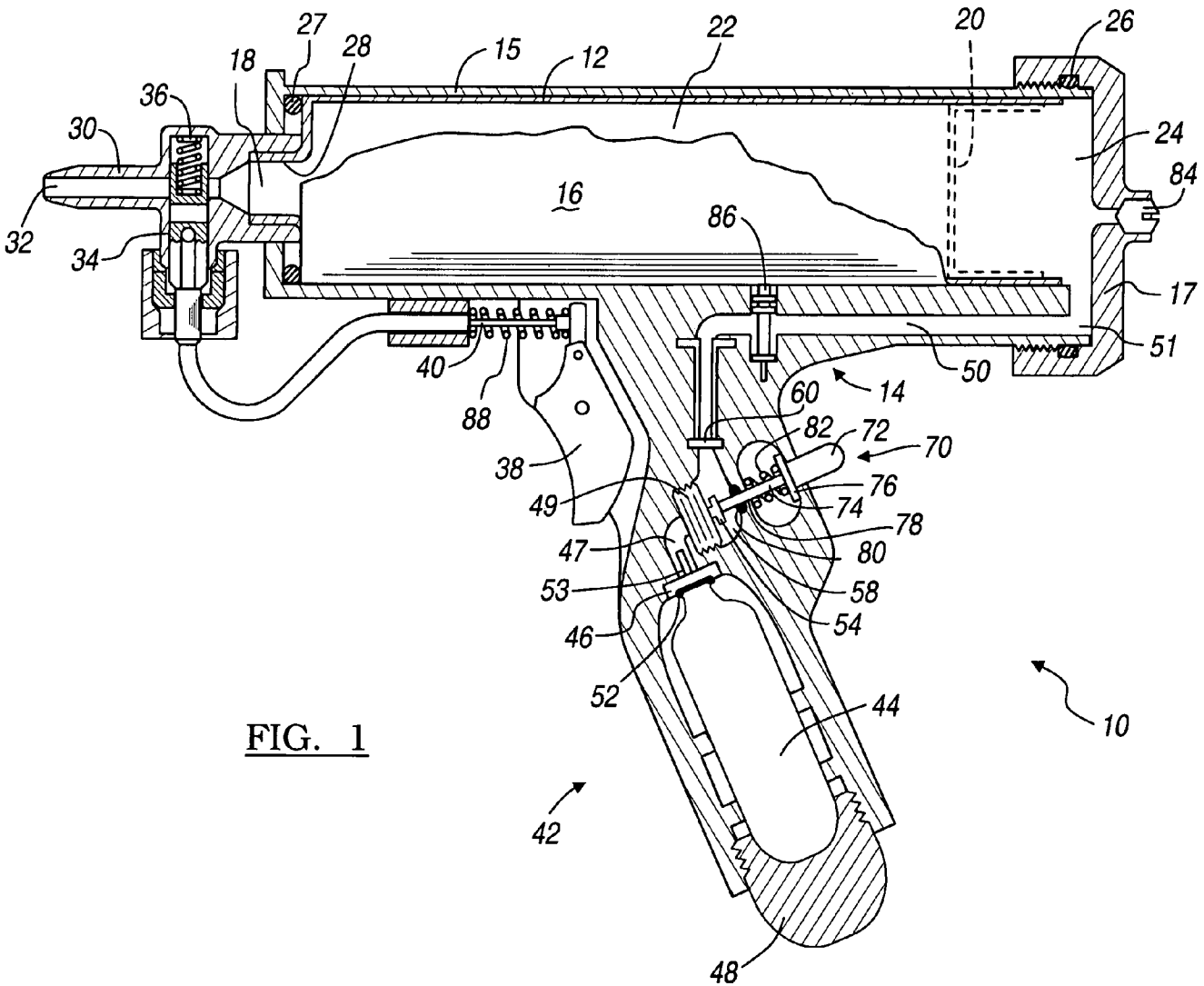
FIG. 1 is a cross-sectional illustration of a dispensing device in accordance with one preferred embodiment of the present invention.
Figure 2:
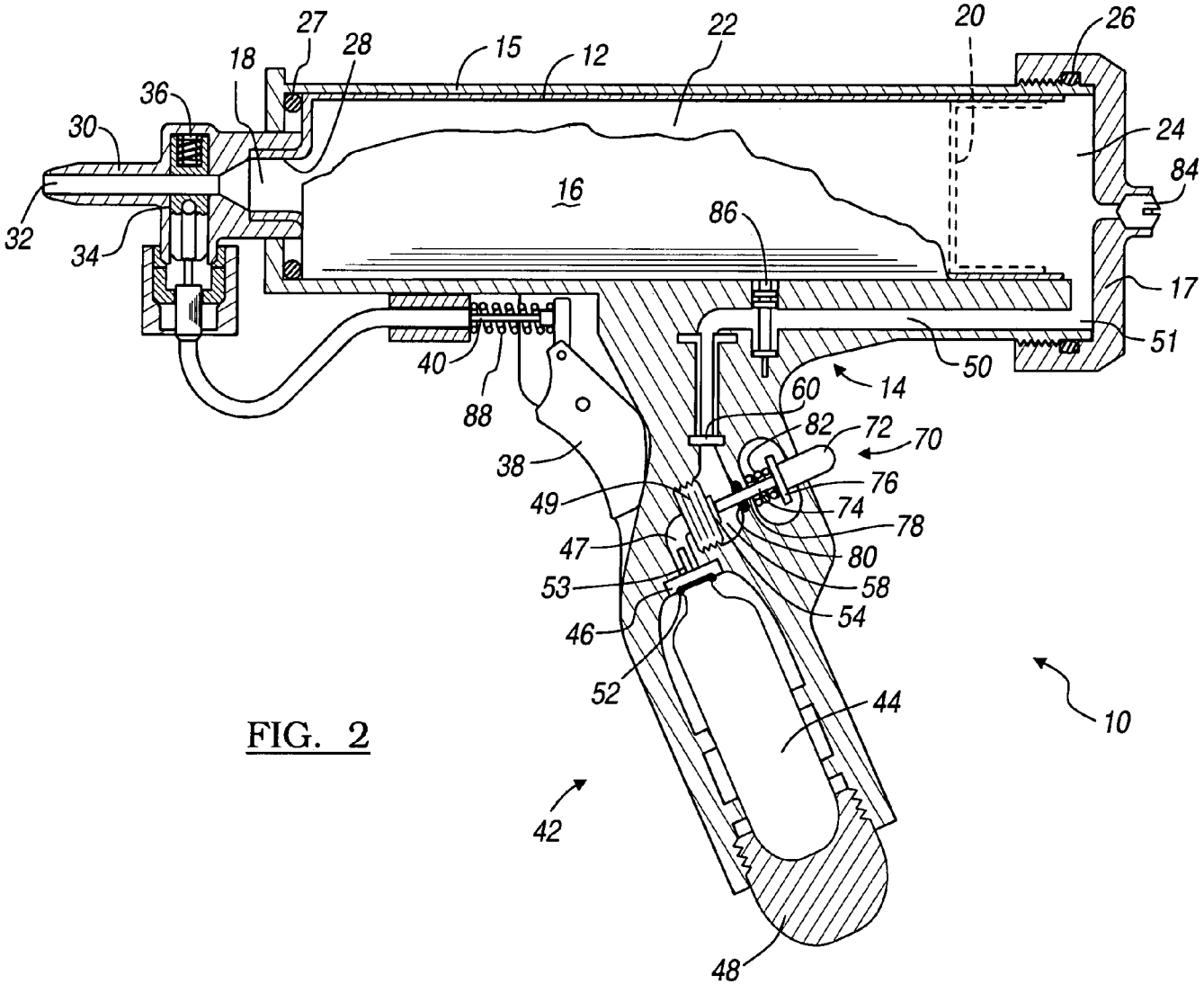
FIG. 2 is a cross-sectional illustration of the preferred embodiment of FIG. 1, shown with a control valve and a dispensing orifice in an open position.

Referring to FIGS. 1 and 2, one preferred embodiment of a dispensing device 10 for dispensing a viscous product from a viscous product cartridge 12 is illustrated. Tubular viscous product cartridges 12 are commonly used in conjunction with or in association with construction adhesives, sealants and caulks. The dispensing device 10 includes a housing 14. The housing 14 includes a pressure vessel, or upper cavity that operates as a cylindrical product cartridge housing component 15. This product cartridge housing component 15 is adapted to retain the viscous product cartridge 12. In the illustrated embodiments, the cartridge housing component 15 is a cylindrical, tubular vessel having a relatively rigid cylindrical wall 16 and is sealed with a removable cap 17, for loading and unloading tubular viscous product cartridges 12.

At one end of such cylindrical tubular product cartridge 12 is a dispensing orifice 18. The dispensing orifice 18 may be provided, for example, by cutting the end of a nozzle (not shown) that is typically provided on many such commercially available viscous product cartridges 12. In addition, it may be necessary to rupture an internal seal (not shown) at the base of the nozzle that seals the dispensing orifice 18 and is often also included in such commercially available product cartridges 12. At the opposite end of the product cartridge 12 is a piston 20 that seals the end of the tube 12. The piston 20 operates as a movable wall that is capable of forcing product from the product enclosure 22 through the dispensing orifice 18 as the piston 20 moves toward the dispensing orifice 18.

As indicated above, the upper portion of the housing 14 operates as a product cartridge housing component 15. The product cartridge housing component 15 is adapted to cooperate with the viscous product cartridge 12 to form a gas enclosure 24 separated from the product enclosure 22 by the movable piston 20. In this embodiment, the removable retaining cap 17 threadedly seals the product cartridge 12 in the product cartridge housing component 15 and uses an O-ring 26 to form a gas enclosure 24 between the housing 14, removable cap 17, and the product cartridge 12. The piston 20 or movable wall separates the gas enclosure 24 from the product enclosure 22 formed inside the product cartridge 12.

Although this embodiment uses product cartridges having a relatively rigid cylindrical wall and a movable piston 20, an alternative product cartridge (not shown) is made of flexible thin-film packaging material. The corresponding product cartridge housing component 15 of this alternative embodiment can still use a movable piston 20 to dispense the product as previously described, or it can be modified providing a gas enclosure that surrounds the flexible side walls. Thus, the side walls can move toward each other under external pressure within the gas enclosure to force product through the dispensing orifice. Accordingly, the flexible thin-film side walls provide the movable wall(s) in this alternative embodiment. It should be understood that additional product cartridge designs can also be used with the present invention, including commonly used squeeze or press tube type cartridges having a substantially cylindrical shape tapered to a flat seal on one end with a dispensing orifice on an opposite end.

The upper portion of the housing 14 also includes a nozzle housing component 30 which is adapted to seal with a wall 28 of the product cartridge 12 that surrounds the dispensing orifice 18. As indicated above, this dispensing orifice 18 can be provided by trimming the end of a nozzle from a standard caulk or adhesive product cartridge. An O-ring 27 is provided for a front pressure seal. Similarly, a rubberized gasket (not shown) may be provided between the nozzle housing component 30 and the wall 28 of the product cartridge 12 to facilitate this seal. As another possible alternative, threads (not shown) may be provided to enable threaded engagement between the wall 28 of the product cartridge 12 and the nozzle housing component 30 to facilitate the seal therebetween.

The nozzle housing component 30 includes a dispensing passage 32 which is selectively opened and closed by a valve body 34. A spring 36 biases the valve body 34 downwardly into a closed position in which the dispensing passage 32 of the nozzle 30 is sealed as seen in FIG. 1. Actuation of a manually operated dispensing trigger 38 causes a cable 40 to counteract the biasing force of the spring 36 and push the valve body 34 upwardly into a dispensing or open position as shown in FIG. 2. In this open position, product can be dispensed from the product cartridge 12 through the dispensing orifice 18 of the product cartridge 12 and through the dispensing passage 32 of the nozzle housing component 30.

In an alternative embodiment (not shown), the nozzle, including the valve body and dispensing passage, may be integrally provided as part of the product cartridge, rather than as part of the housing. This configuration eliminates the need to seal the dispensing orifice of the product cartridge and the dispensing passage of the device housing together. In contrast, the preferred embodiment described above enables re-use of the nozzle and valve assembly with multiple disposable product cartridges.

As indicated above, a lower portion of the housing 14 of the dispensing device 10 operates as a handle 42 for manually grasping the dispensing device 10. The manually actuated dispensing trigger 38 mentioned above is associated with the handle 42. In a preferred embodiment, the handle provides a gas cartridge housing component 42. The gas cartridge housing component 42 is adapted to retain a gas cartridge 44 in sealed fluid communication with an inlet 46 that is associated with a manually actuated control valve 49. A fluid passage 50 provides fluid communication between the gas enclosure 24 and the inlet 46 located in the handle portion 42 of the housing 14.

Specifically, the inlet 46 adjacent to the gas cartridge 44 includes a resilient gasket seal member 52. In addition, the inlet 46 may include a piercing member 53 to pierce an opening in the gas cartridge 44 upon sealing to the inlet 46. The gas cartridge housing component 42 includes a removable housing member 48. As this housing member 48 is screwed onto the gas cartridge housing component 42, the $CO_2$ gas cartridge 44 is pushed into sealing engagement with the gasket 52 of the inlet 46. If present, screwing the housing member 48 onto the gas cartridge housing component 42 causes the piercing member 53 to pierce the gas cartridge 44. In any event, sealed fluid communication is provided between the interior of the gas cartridge 44 and the fluid passage 50.

Figures 3, 3A:
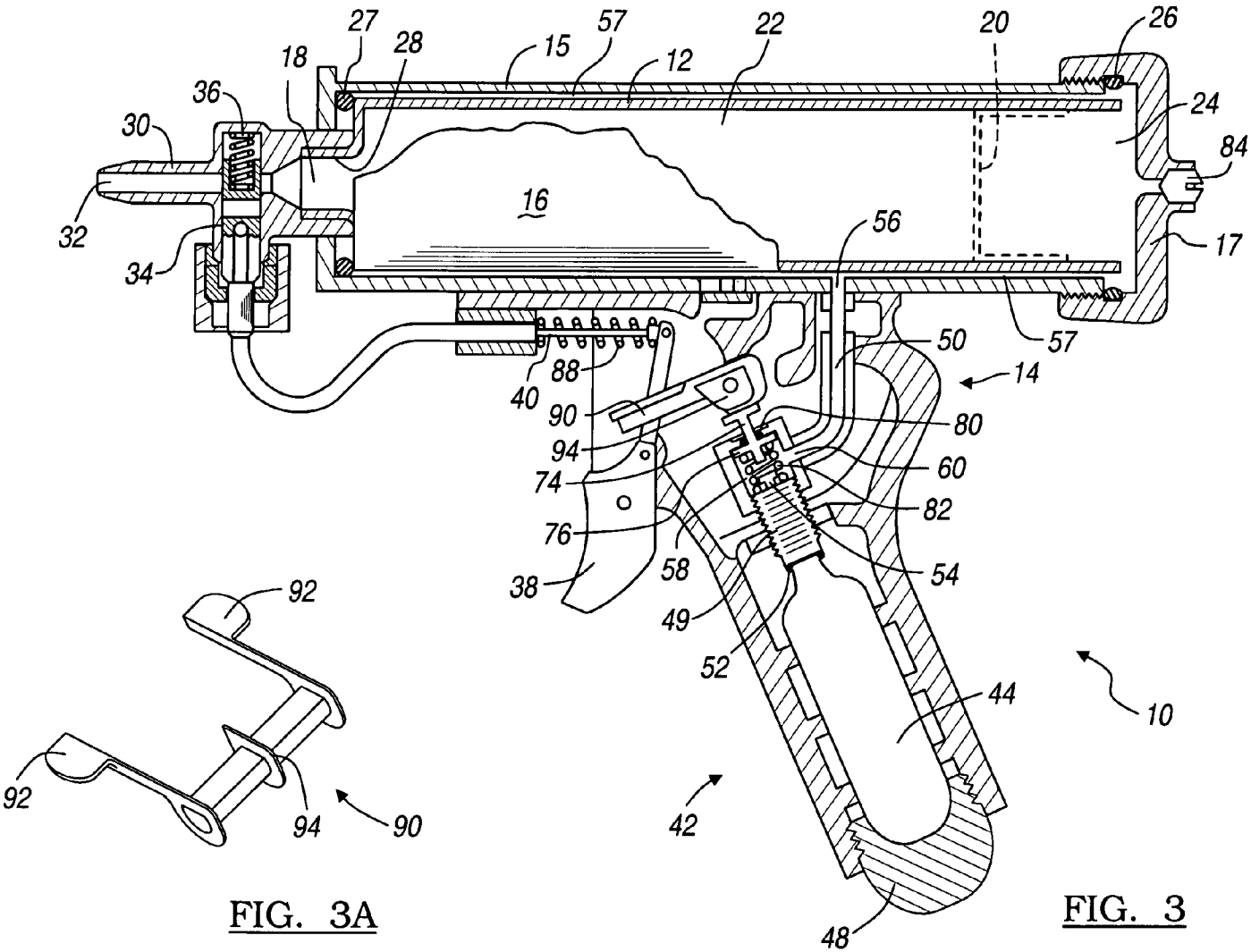
FIG. 3 is a cross sectional illustration of a dispensing device in accordance with a second preferred embodiment.
FIG. 3A is a magnified, isometric view of a rotary pressurizing trigger of the dispensing device of FIG. 3.
Figure 4:
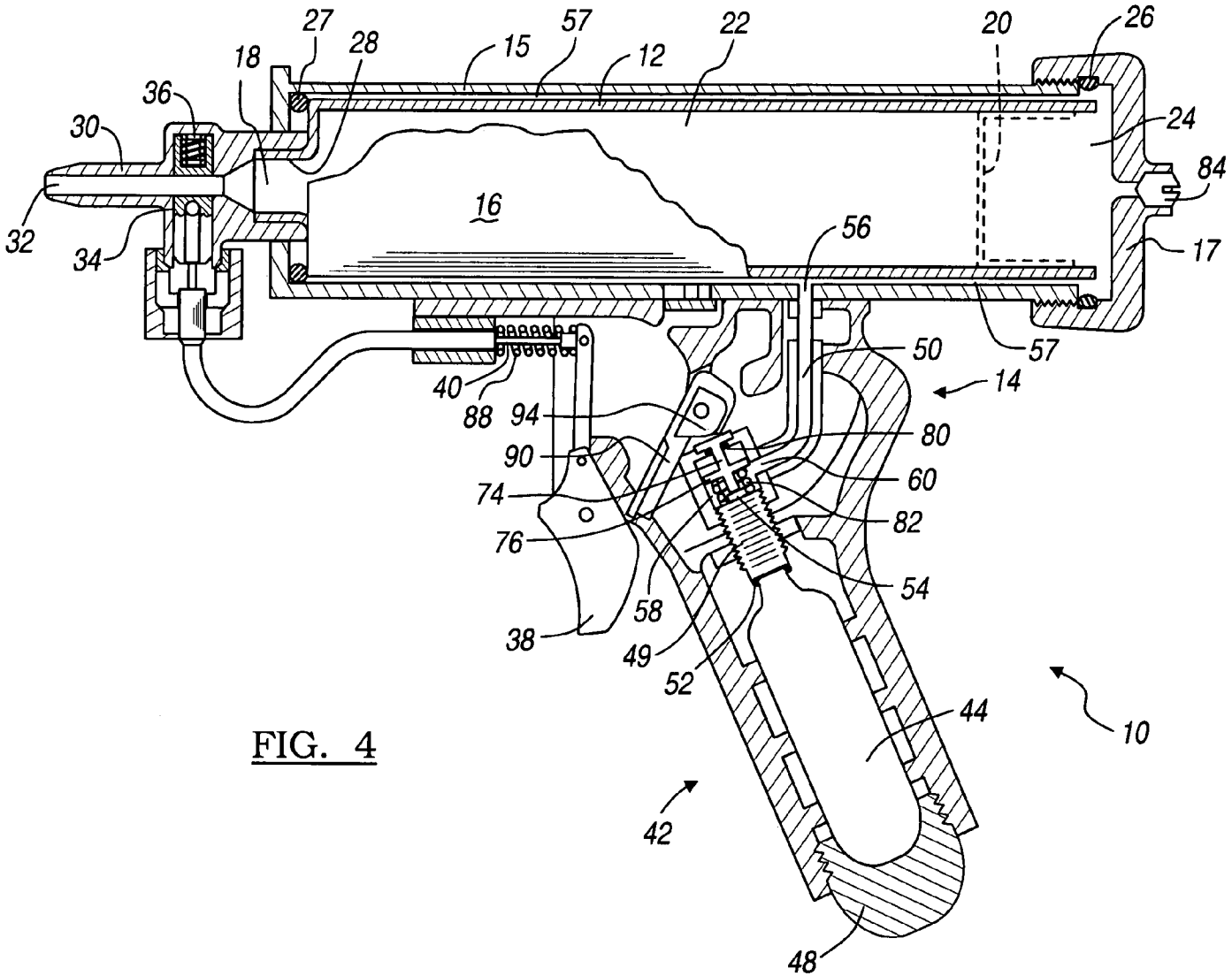
FIG. 4 is a cross-sectional illustration of the second preferred embodiment of FIG. 3, shown with a control valve and a dispensing orifice in an open position.

In the illustrated embodiment, the manually actuated control valve 49 associated with the inlet 46 is a standard Schrader valve. While the illustrated embodiments in FIGS. 1 and 2 depict the inlet 46 in direct communication the gas cartridge 44, alternatively FIGS. 3 and 4 have the control valve 49 sealing the gas cartridge 44 after it has been pierced during installation. Such valves are quite well known to those skilled in the art, and therefore, the complete structural details of the control valve 49 have not been illustrated in the drawings. In brief, the Schrader valve includes a valve stem 54 which operates as an actuator that, when depressed, opens the valve 49 to allow gas to pass through the valve 49. This position of the stem 54 corresponds to an open position of the valve 49 and is illustrated in FIGS. 2 and 4. When the valve stem 54 is released, it is biased to move outwardly into a closed position that prevents gas from passing through the valve 49. This position of the stem 54 or actuator corresponds to a closed position of the valve 49 and is illustrated in FIGS. 1 and 3.

The overall fluid passage 50 and the gas enclosure 24 define an operator-regulated gas pressure enclosure. The overall fluid passage 50 includes a passage through the Schrader valve 49 and the initial cavity 58 into which gas exiting the Schrader valve 49 flows. In addition, the overall fluid passage can include an opening 60 through which gas exits the initial cavity 58 and continues through the passage 50 extending to the gas enclosure 24. It should be understood that the fluid passage 50 will vary depending upon the housing design and the desired method of pressurizing the gas enclosure. As shown in FIGS. 1 and 2, the fluid passage 50 extends toward the retaining cap 17, and pressurizes the gas enclosure 24 via outlet 51 directed near the movable wall 20. Alternatively, as shown in FIGS. 3 and 4, fluid passage 50 is in fluid communication with a center portion 56 of the cartridge housing component 15. In this embodiment, the viscous product cartridge 12 is preferably smaller than the cartridge housing component 15 enabling pressurized gas to surround the entire cartridge 12 periphery, thereby filling a gap 57 between the cartridge housing component 15 and the cartridge 12 and allowing the pressurized gas to act upon the movable wall 20.

With reference to FIGS. 1 and 2, a pressurizing trigger 70 is located adjacent the initial cavity 58 and valve stem 54. Preferably, pressurizing trigger 70 is positioned on the handle 42 such that a user can engage the dispensing trigger 38 and the pressurizing trigger 70 with digits from the same hand. The pressurizing trigger 70 includes an exterior button 72, a shaft 74, and a stop 76. Trigger 70 is adapted to slidingly retract into initial cavity 58 and to engage the valve stem 54. Shaft 74 is guided by a shaft passageway 78 that includes an O-ring 80 to provide a fluid sealing interface. Spring 82 is superposed on shaft 74 and biases shaft 74 away from valve stem 54. Stop 76 limits the outward travel of trigger 70 and serves as a spring seat.

Upon inserting the $CO_2$ cartridge 44 into the cartridge housing 42 and threading the housing member 48, the cartridge 44 is sealed to the inlet 46 of the inlet area 47. The biasing force of the spring 82 initially keeps the shaft 74 of the pressurizing trigger 70 opposed from the valve stern 54. Once the pressurizing trigger 70 is engaged, shaft 74 linearly actuates the valve stem 54 of the control valve 49 allowing gas flow from the pressurized cartridge 44 through the inlet area 47 and across the control valve to the initial cavity 58 which is part of the operator-regulated gas pressure enclosure. Pressure within the initial cavity 58 increases and gas flows through an opening 60 to the fluid passage 50 to the gas enclosure 24.

As pressure within the gas enclosure 24 increases, the gas pressure therein generates a force that acts upon the face of the piston, or movable wall 20. Once the pressure reaches a pre-determined value, the main pressure-relief valve 84 begins to leak or whistle, thereby producing an audible signal informing the operator that the device holds a sufficient pressure in the gas enclosure 24 to allow dispensing of the viscous product. Preferably, the relief pressure is adjustable between about 15 and 75 psi to accommodate different types of sealant, caulk, and viscous products. The preset relief pressure should be selected to affect a desirable dispensing rate of product without unnecessarily increasing the pressure in the gas enclosure 24. Alternative embodiments include the use of pressure gauges or other visual indication means as are known to those skilled in the art. An emergency relief valve 86 is also present to release excess gas to the atmosphere via a passage (not shown) in the event a pressure in the gas chamber 24 reaches a threshold, or maximum value. It should be understood that the placement of the emergency relief valve will vary depending upon the housing design of the device 10.

In one embodiment, the main pressure relief valve 84 can be adjusted to control the amount of gas pressure required to pneumatically initiate the audible signal. Variable pressure relief valves are generally known in the art. Typical valves include a housing with an orifice and a channel that threadedly engages with an adjustment screw having a gas vent therein. A plug is disposed between the screw and the orifice, separated by a tension spring. As the adjustment screw is rotated in a clockwise direction, the spring tension increases on the plug and a higher pressure is required through the orifice to displace the plug. Similarly, as the adjustment screw is rotated in a counter-clockwise direction, the pressure required to release the plug is reduced. The hole in the gas vent can be formed with a pre-determined diameter adapted to generate a whistling type noise at a desired pressure threshold.

Additionally, the main pressure relief valve 84 may be manually moved to an open position to permit the release of pressure from the gas enclosure 24. This release of pressure can, for example, facilitate the replacement of the viscous product cartridge 12. In an alternative and simpler embodiment, the device is not equipped with a signal producing relief valve or indicator. In this case, the user of the device is instructed by the manufacturer to pressurize the gas chamber by activating the pressurizing trigger 70 for a pre-determined time, thereby pressurizing the gas enclosure 24 to a sufficient pressure to allow the dispensing of the viscous product.

Once the device 10 is pressurized, the user can engage the dispensing trigger 38 which causes the cable 40 to counteract the biasing force of the spring 36 and push the valve body 34 to the dispensing position, allowing the release of viscous product from the tip of the dispensing passage 32. The dispensing trigger 38 is biased to a closed position by a spring 88. The dispensing trigger 38 is connected to the nozzle valve 34 and opens the valve upon manual actuation. As the piston 20 begins to move, the volume of the gas enclosure 24 expands, reducing the volume of the product enclosure 22 and dispensing product from the dispensing passage 32. Upon release of the dispensing trigger 38, the discharge valve 34 moves to its closed position and product is no longer dispensed.

During the dispensing operation, the increase in size of the gas enclosure 24 causes the pressure level within the overall regulated gas pressure enclosure, including the initial cavity 58, to fall. When the pressure level falls significantly after continuous dispensing, the user will need to re-pressurize the system by engaging the pressurizing trigger 70, 90 again, either for a designated time period or until an indicator indicates a suitable operating pressure, as previously described.

Operation of the dispensing device 10 involves locating a product cartridge 12 in the product cartridge retaining housing compartment 15. As previously described, this creates a gas enclosure 24 separated from a product enclosure 22 by a movable wall 20. In addition, operation of the dispensing device involves locating a $CO_2$ cartridge 44 inside the gas cartridge retaining housing component 42. This is accomplished by screwing on the housing member 48 to the gas cartridge housing unit.

Referring to FIGS. 2 and 4, manually actuating the dispensing trigger 38 causes the nozzle valve to move to an open position. Pressurized gas from the gas enclosure 24 forces the movable wall 20 to slide towards the dispensing nozzle, thereby displacing viscous product through the dispensing passage 32.

Referring to FIGS. 3 and 4, a second preferred embodiment of a dispensing device 10 for dispensing a viscous product from a viscous product cartridge is illustrated. This embodiment provides a rotary driven pressurizing trigger 90. Although the rotary trigger 90 and corresponding components are not identical to the pressurizing trigger of FIGS. 1 and 2, they function in the same manner. The rotary trigger 90, as shown in FIG. 3A, has at least one external thumb control lever 92, which is operable to rotate a cam 94 when depressed by the device operator. The rotary trigger 90 is similarly positioned in the handle 42 such that a user can engage the dispensing trigger 38 and the rotary trigger 90 with digits from the same hand. The cam 94 is adapted to rotatably engage the valve stem 54 of the control valve 49 allowing gas flow from the pressurized cartridge 44 through the control valve and into the initial cavity 58. Pressure within the initial cavity 58 increases and flows to the fluid passage 50 and into the gap 57 and to the gas enclosure 24. The remainder of this embodiment is essentially identical in form and function to the embodiments of FIGS. 1 and 2. Consequently, the remainder of this embodiment is not described here again.

Only a small number of the many possible alternatives are described above. Many additional modifications and alternatives beyond those described above, may be envisioned by those skilled in the art. For example, as illustrated in FIGS. 1 and 2, the Schrader valve is associated with the inlet of the fluid passage as a result of being located within the fluid passage. In another embodiment illustrated in FIGS. 3 and 4, the pressurized gas cartridge includes the Schrader valve. Thus, the Schrader valve is associated with the inlet of the fluid passage when the pressurized gas cartridge is associated with the inlet. As another potential modification, the pressurizing trigger may be disposed at other convenient locations on the handle portion of the housing. In other modifications, the operator actuated control elements may be provided with locks and other adjustable control settings.

The description of the invention is merely exemplary in nature and, thus, variations that do not depart from the gist of the invention are intended to be within the scope of the invention. Such variations are not to be regarded as a departure from the spirit and scope of the invention.

What is claimed is:

1. A device for dispensing a viscous product, the device comprising;

a housing component having a cavity and a dispensing orifice;

a movable wall positioned in said cavity operable to separate a product enclosure from a gas enclosure;

a fluid passage providing fluid communication between a pressurized gas source and said gas enclosure;

a manually actuated control valve associated with said pressurized gas source, said control valve having an actuator which, upon actuation, is adapted to release gas from said pressurized gas source into said fluid passage and said gas enclosure;

a pressure relief valve in fluid communication with said gas enclosure;

an operator-activated trigger mechanism operable to open said orifice; and a second operator-activated trigger mechanism located adjacent said actuator of said control valve and operable to engage said actuator;

wherein said movable wall is configured to move in response to a force exerted by said pressurized gas enclosure so as to cause the viscous product to dispense from said orifice.

2. A device for dispensing a viscous product according to claim 1, wherein said pressure relief valve is adapted to indicate a pre-determined pressure in said gas enclosure.

3. A device for dispensing a viscous product according to claim 2, wherein said pressure relief valve produces an audible signal.

4. A device for dispensing a viscous product according to claim 3, wherein an adjustment mechanism is associated with said pressure relief valve operable to adjust said pre-determined pressure.

5. A device for dispensing a viscous product according to claim 2, wherein said second operator-activated trigger mechanism engages said actuator upon linear movement.

6. A device for dispensing a viscous product according to claim 1, wherein said second operator-activated trigger mechanism engages said actuator upon rotary movement.

7. A device for dispensing a viscous product from a viscous product cartridge, the device comprising:

a first housing component adapted to retain the viscous product cartridge and operable to cooperate with the viscous product cartridge to form a gas enclosure separated from a product enclosure by a movable wall;

a second housing component having an inlet in sealed fluid communication with said gas enclosure;

a fluid passage providing fluid communication between said inlet and said gas enclosure;

a pressurized gas source in fluid communication with said inlet;

a manually actuatable control valve having an actuator and associated with said pressurized gas source, which, upon actuation, is operable to release gas from said pressurized gas source through said inlet and into said fluid passage, and said manually actuatable control valve further adapted to return said actuator to a closed position subsequent said actuation;

an operator-actuated trigger mechanism adapted to permit dispensing of the viscous product; and a second operator-activated trigger mechanism located adjacent said actuator of said control valve, wherein engagement of said second trigger actuates said control valve, thereby releasing a pressurized gas into said gas enclosure.

8. A device for dispensing a viscous product according to claim 7, further comprising a pressure relief valve in fluid communication with said gas enclosure.

9. A device for dispensing a viscous product according to claim 8, wherein said pressure relief valve cooperates with a pneumatic indicator to produce an audible signal when a pressure in said gas enclosure exceeds a pre-determined pressure.

10. A device for dispensing a viscous product according to claim 9, wherein an adjustment mechanism is associated with said pressure relief valve operable to adjust said pre-determined pressure.

11. A device for dispensing a viscous product according to claim 9, wherein said pressure relief valve is adjustable between about 15 and about 75 psi.

12. A device for dispensing a viscous product according to claim 7, wherein said trigger mechanism is operable to engage said actuator upon linear movement.

13. A device for dispensing a viscous product according to claim 7, wherein said trigger mechanism is operable to engage said actuator upon rotary movement.

14. A device for dispensing a viscous product according to claim 7, wherein said second housing is adapted to retain said pressurized gas cartridge.

15. A device for dispensing a viscous product according to claim 7, wherein said movable wall is a wall of the viscous product cartridge.

16. A method for facilitating the pressurized discharge of a viscous product from a viscous product cartridge, the method comprising:

providing a cavity in a dispensing device adapted to discharge the viscous product from the viscous product cartridge;

integrating a gas enclosure chamber within a housing of said dispensing device;

supplying a control valve adapted to selectively permit gas flow from a pressurized gas source to a fluid passage;

connecting said fluid passage to said gas enclosure;

incorporating an indicator operable to signal a pre-determined pressure in said gas enclosure;

opening an orifice to discharge the viscous product from the viscous product cartridge with an operator-activated trigger mechanism; and opening said control valve to selectively permit gas flow from said pressurized gas source to said fluid passage with a second operator-activated trigger mechanism.

17. A method according to claim 16, wherein said signal is audible and driven by pneumatic means.

18. A method according to claim 16, further comprising providing a recommended time for allowing pressurization of said gas enclosure.

* * * * *